US005792555A

United States Patent [19]

Bak et al.

[11] Patent Number: 5,792,555

[45] Date of Patent: Aug. 11, 1998

[54] HYBRID YARN AND PERMANENT DEFORMATION CAPABLE TEXTILE MATERIAL PRODUCED THEREFROM, ITS PRODUCTION AND USE

[75] Inventors: Henning Bak; Bent Lichscheidt; Hans Knudsen, all of Silkeborg, Denmark

[73] Assignee: Hoechst Aktiengesellschaft, Germany

[21] Appl. No.: 630,138

[22] Filed: Apr. 10, 1996

[30] Foreign Application Priority Data

Apr. 10, 1995 [DE] Germany ..... 195 13 506.7

[51] Int. Cl.[6] ..... D02G 3/04; D03D 3/00

[52] U.S. Cl. ..... 428/373; 428/369; 442/197; 442/310; 442/352; 442/353

[58] Field of Search ..... 428/373, 369; 442/197, 310, 352, 353

[56] References Cited

U.S. PATENT DOCUMENTS

| | | | |
|---|---|---|---|
| 5,364,686 | 11/1994 | Disselbeck et al. | 428/174 |
| 5,366,797 | 11/1994 | Rotgers et al. . | |

FOREIGN PATENT DOCUMENTS

| | | |
|---|---|---|
| A 0 144 939 | 6/1985 | European Pat. Off. . |
| A 0 156 599 | 10/1985 | European Pat. Off. . |
| A 0 156 600 | 10/1986 | European Pat. Off. . |
| A 0 268 838 | 6/1988 | European Pat. Off. . |
| A-0 303 499 | 2/1989 | European Pat. Off. . |
| A- 0 326 409 | 8/1989 | European Pat. Off. . |
| A 0 351 201 | 1/1990 | European Pat. Off. . |
| A 0 354 139 | 2/1990 | European Pat. Off. . |
| A 369 395 | 5/1990 | European Pat. Off. . |
| A 0 378 381 | 7/1990 | European Pat. Off. . |
| 0 551 832 | 7/1993 | European Pat. Off. . |
| A 0 551 832 | 7/1993 | European Pat. Off. . |
| A 29 20 513 | 11/1979 | Germany . |
| A 34 08 769 A1 | 9/1985 | Germany . |
| GBM 8521108 | 2/1986 | Germany . |
| A 40 42 063 A1 | 7/1992 | Germany . |
| A 42 43 465 | 7/1993 | Germany . |
| A 04 353525 | 12/1992 | Japan . |

OTHER PUBLICATIONS

Chemiefasern/Textiltechnik 39/91, 1989, Seiten T185–T187, T224–T228 T236–T240 (considered to the extend described in the specification).

*Primary Examiner*—Kathleen Choi
*Attorney, Agent, or Firm*—Connolly & Hutz

[57] ABSTRACT

Described are a hybrid yarn consisting of two groups of filaments, one group consisting of one or more varieties of reinforcing filaments (filaments (A)) and the other group consisting of one or more varieties of matrix filaments (filaments (B)), wherein the filaments (A) of the first group have an initial modulus of above 600 cN/tex, preferably of 800 to 25,000 cN/tex, in particular of 2,000 to 20,000 cN/tex, a tenacity of above 60 cN/tex, preferably of 80 to 220 cN/tex, in particular of 100 to 200 cN/tex, and a breaking extension of 0.01 to 20%, preferably of 0.1 to 7.0%, in particular of 1.0 to 5.0%, the filaments (B) of the second group are thermoplastic filaments which have a melting point which is at least 10° C., preferably 20° to 100° C., in particular 30° to 70° C., below the melting point of the filaments (A), the filaments (A) have a crimp of S to 60%, preferably of 12 to 50%, in particular of 18 to 36%, a three-dimensionally deformable sheet material produced from this hybrid yarn, and a fiber reinforced shaped article produced from the deformable sheet material.

32 Claims, No Drawings

HYBRID YARN AND PERMANENT DEFORMATION CAPABLE TEXTILE MATERIAL PRODUCED THEREFROM, ITS PRODUCTION AND USE

BACKGROUND OF THE INVENTION

The present invention relates to a hybrid yarn comprising reinforcing filaments and thermoplastic matrix filaments and permanent deformation capable, e.g. deep-drawable, textile sheet materials produced therefrom. The invention further relates to the shaped fiber reinforced thermoplastic articles which are produced by deforming the deformable textile sheets of the invention and which, owing to the uni- or multidirectionally disposed, essentially elongate reinforcing filaments, possess a specifically adjustable high strength in one or more directions. Hybrid yarns from unmeltable (e.g. glass or carbon fiber) and meltable fibers (e.g. polyester fiber) are known. For instance, the patent applications EP-A-0,156,599, EP-A-0,156,600, EP-A-0,351,201 and EP-A-0,378,381 and Japanese Publication JP-A-04/353,525 concern hybrid yarns composed of nonmeltable fibers, e.g. glass fibers, and thermoplastic, for example polyester, fibers. Similarly, EP-A-0,551,832 and DE-A-2,920,513 concern combination yarns which, although ultimately bonded, are first present as hybrid yarn.

It is also known to use hybrid yarns having a high-melting or unmeltable filament content and a thermoplastic lower-melting filament content to produce sheet materials which, by heating to above the melting point of the thermoplastic, lower-melting yarn component, can be converted into fiber reinforced, stiff thermoplastic sheets, a kind of organic sheet-metal.

Various ways of producing fiber reinforced thermoplastic sheet are described in Chemiefasern/Textiltechnik, volume 39/91 (1989) pages T185 to T187, T224 to T228 and T236 to T240. The production starting from sheetlike textile materials composed of hybrid yarns is described there as an elegant way, which offers the advantage that the mixing ratio of reinforcing and matrix fibers can be very precisely controlled and that the drapability of textile materials makes it easy to place them in press molds (Chemiefasern/Textiltechnik, volume 39/91 (1989), page T186).

As revealed on page T238/T239 of this publication, however, problems arise when the textile materials are to be deformed in two dimensions. Since the extensibility of the reinforcing threads is generally negligible, textile sheets composed of conventional hybrid yarns can only be deformed because of their textile construction. However, this deformability generally has narrow limits if creasing is to be avoided (T239), an experience that was confirmed by computer simulations. The solution of pressing textiles composed of reinforcing and matrix threads in molds has the disadvantage that partial squashing occurs, which leads to a dislocation and/or crimping of the reinforcing threads and an attendant decrease in the reinforcing effect. A further possibility discussed on page T239/T240 of producing three-dimensionally shaped articles having undislodged reinforcing threads would involve the production of three-dimensionally woven preforms, which, however, necessitates appreciable machine requirements, not only in the production of the preforms but also in the impregnation or coating of the thermoplastic.

A fundamentally different way of producing shaped fiber reinforced thermoplastic articles is to produce a textile sheet which consists essentially only of reinforcing yarns, place it as a whole or in the form of smaller sections in or on molds, apply a molten or dissolved or dispersed matrix resin as impregnant, and allow the resin to harden by cooling or evaporating the solvent or dispersing medium. This method can also be varied by impregnating the reinforcing textile before placing it in or on the mold and/or by pressing the reinforcing textile and a thermoplastic matrix resin into the desired shape in closed molds, at a working temperature at which the matrix resin will flow and completely enclose the reinforcing fibers.

Reinforcing textiles for this technology are known for example from German Utility Model 85/21,108. The material described therein consists of superposed longitudinal and transverse thread layers connected together by additional longitudinal threads made of a thermoplastic material. A similar reinforcing textile material is known from EP-A-0,144,939. This textile reinforcement consists of warp and weft threads overwrapped by threads made of a thermoplastic material which cause the reinforcing fibers to weld together on heating.

A further reinforcing textile material is known from EP-A-0,268,838. It too consists of a layer of longitudinal threads and a layer of transverse threads, which are not interwoven, but one of the plies of threads should have a significantly higher heat shrinkage capacity than the other. In the material known from this publication, the cohesion is brought about by auxiliary threads which do not adhere the layers of the reinforcing threads together but fix them loosely to one another so that they can still move relative to one another.

Improved deformability of reinforcing layers is the object of a process known from DE-A-4,042,063. In this process, longitudinally deformable, namely heat-shrinking, auxiliary threads are incorporated into the sheet material intended for use as textile reinforcement. Heating releases the shrinkage and causes the textile material to contract somewhat, so that the reinforcing threads are held in a wavy state or in a loose overlooping.

DE-A-3,408,769 discloses a process for producing shaped fiber reinforced articles from thermoplastic material by using flexible textile structures consisting of substantially unidirectionally aligned reinforcing fibers and a matrix constructed from thermoplastic yarns or fibers. These semifinished products are given their final shape by heatable profile dies by melting virtually all the thermoplastic fibers.

A semifinished sheet material for producing shaped fiber reinforced thermoplastic articles is known from BP-A-0,369,395. This material consists of a thermoplastic layer embedding a multiplicity of spaced-apart parallel reinforcing threads of very low breaking extension which at regular intervals exhibit deflections which form a thread reservoir. On deforming these semifinished sheet products, the deflections of the reinforcing threads are pulled straight—avoiding thread breakage.

From the fabrication standpoint the most advantageous semifinished products have a textile character, i.e. are drapable, and include both the reinforcing fibers and the matrix material. Of particular advantage will be those which have a precisely defined weight ratio of reinforcing fibers to matrix material. The prior art drapable semifinished products with a defined ratio of reinforcing fibers and matrix material can be placed in press molds and pressed into shaped articles, but, after deforming, frequently no longer have the ideal arrangement and elongation of the reinforcing fibers because of the squashing during pressing. Reinforcing layers, for example those known from DE-A-4,042,063, are three-dimensionally deformable, for example by deep drawing, and generally make it possible to achieve the desired arrangement and elongation of the reinforcing fibers, but have to be embedded into the matrix material in an additional operation. Deep drawable fiber reinforced semifinished products, such as those known from EP-A-0,369,395, are difficult to manufacture because of the complicated wavelike arrangement of the reinforcing yarns.

SUMMARY AND DETAILED DESCRIPTION OF THE INVENTION

It has now been found that the disadvantages of the prior art are substantially overcome by a sheetlike semifinished product which has textile character and which is capable of permanent deformation, for example by deep drawing, and which includes both reinforcing fibers and matrix material in a defined weight ratio. Such an advantageous semifabricate can be produced by weaving or knitting, but also by cross-laying or other known processes for producing sheetlike textiles on known machines, starting from a hybrid yarn which forms part of the subject-matter of this invention.

Hereinafter and for the purposes of this invention, the terms "fiber", "fibers" and "fibrous" are also to be understood as meaning "filament", "filaments" and "filamentous".

The hybrid yarn of this invention consists of two groups of filaments, one group consisting of one or more varieties of reinforcing filaments (filaments (A)) and the other group consisting of one or more varieties of matrix filaments (filaments (B)), wherein

- the filaments (A) of the first group have an initial modulus of above 600 cN/tex, preferably of 800 to 25,000 cN/tex, in particular of 2,000 to 20,000 cN/tex, a tenacity of above 60 cN/tex, preferably of 80 to 220 cN/tex, in particular of 100 to 200 cN/tex, and a breaking extension of 0.01 to 20%, preferably of 0.1 to 7.0%, in particular of 1.0 to 5.0%,
- the filaments (B) of the second group are thermoplastic filaments which have a melting point which is at least 10° C., preferably 20° to 100° C., in particular 30° to 70° C., below the melting point of the filaments (A),
- the filaments (A) have a crimp of 5% to 60%, preferably of 12 to 50%, in particular of 18 to 36%.

Advantageously the filaments have been interlaced. This has the advantage that, because of its improved bundle coherency, the hybrid yarn is easier to process into sheet materials on conventional machines, for example weaving or knitting machines, and that the intimate mixing of the reinforcing and matrix fibers results in very short flow paths for the molten matrix material and excellent, complete embedding of the reinforcing filaments in the thermoplastic matrix when producing shaped fiber reinforced thermoplastic articles from the sheetlike textile material. Advantageously the degree of interlacing is such that a measurement of the entanglement spacing with an ITEMAT hook drop tester (as described in U.S. Pat. No. 2,985,995) gives values of <200 mm, preferably within the range from 5 to 100 mm, in particular within the range from 10 to 30 mm.

The fibers of variety (A) have a crimp, i.e. they form a sequence of small or larger arcs. "Crimp" for the purposes of this invention is the nonelongate, wave-shaped course of the filaments (A) in the hybrid yarn, which is caused by the length of the filaments (A) being greater than the yarn length containing them.

The hybrid yarn of this invention advantageously has a linear density of 100 to 25,000 dtex, preferably 150 to 15,000 dtex, in particular 200 to 10,000 dtex.

The proportion of the filaments (A) is 20 to 90, preferably 35 to 85, in particular 45 to 75, % by weight, the proportion of the filaments (B) is 10 to 80, preferably 15 to 45, in particular 20 to 55, % by weight and the proportion of the rest of the fibrous constituents is 0 to 70, preferably 0 to 50, in particular 0 to 30, % by weight of the hybrid yarn of this invention.

The proportion of the thermoplastic fibers (B) whose melting point is at least 10° C. below the melting point of the reinforcing fibers (A) is 10 to 80, preferably 15 to 45, in particular 20 to 40, % by weight of the hybrid yarn of this invention.

Advantageously the filaments (A), which form the reinforcing filaments in the end product, i.e. in the three-dimensionally shaped fiber reinforced thermoplastic article, have a dry heat shrinkage maximum of below 3%. These filaments (A) advantageously have an initial modulus of above 600 cN/tex, preferably 800 to 25,000 cN/tex, in particular 2000 to 20,000 cN/tex, a tenacity of above 60 cN/tex, preferably 80 to 220 cN/tex, in particular 100 to 200 cN/tex, and a breaking extension of 0.01 to 20%, preferably 0.1 to 7.0%, in particular 1.0 to 5.0%.

In the interests of a typical textile character with good drapability, the filaments (A) have linear densities of 0.1 to 20 dtex, preferably 0.4 to 16 dtex, in particular 0.8 to 10 dtex. In cases where the drapability does not play a big part, it is also possible to use reinforcing filaments having linear densities greater than 20 dtex.

The filaments (A) are either inorganic filaments or filaments of high performance polymers or preshrunk and/or set organic filaments made of other organic polymers suitable for producing high tenacity filaments.

Examples of inorganic filaments are glass filaments, carbon filaments, filaments of metals or metal alloys such as steel, aluminum or tungsten; nonmetals such as boron; or metal or nonmetal oxides, carbides or nitrides such as aluminum oxide, zirconium oxide, boron nitride, boron carbide or silicon carbide; ceramic filaments, filaments of slag, stone or quartz. Preference for use as inorganic filaments (A) is given to metal, glass, ceramic or carbon filaments, especially glass filaments. Glass filaments used as filaments (A) have a linear density of preferably 0.15 to 3.5 dtex, in particular 0.25 to 1.5 dtex.

Filaments of high performance polymers for the purposes of this invention are filaments of polymers which produce filaments having a very high initial modulus and a very high breaking strength or tenacity without or with only minimal drawing, and with or without a heat treatment following spinning. Such filaments are described in detail in Ullmann's Encyclopedia of Industrial Chemistry, 5th edition (1989), volume A13, pages 1 to 21, and also volume 21, pages 449 to 456. They consist for example of liquid crystalline polyesters (LCPs), poly (bisbenzimidazobenzophenanthroline) (BBB), poly (amideimide) s (PAI), polybenzimidazole (PBI), poly(p-phenylenebenzobisoxazole) (PBO), poly(p-phenylenebenzobisthiazole) (PBT), polyetherketone (PEK), polyetheretherketone (PEEK), polyetheretherketoneketone (PEEK), polyetherimides (PEI), polyether sulfone (PESU), polyimides (PI), aramids such as poly(m-phenyleneisophthalamide) (PMIA), poly(m-phenyleneterephthalamide) (PMTA), poly(p-phenyleneisophthalamide) (PPIA), poly(p-phenylenepyromellitimide) (PPPI), poly(p-phenylene) (PPP), poly(phenylene sulfide) (PPS), poly(p-phenyleneterephthalamide) (PPTA) or polysulfone (PSU).

Preferably the filaments (A) are preshrunk and/or set aramid, polyester, polyacrylonitrile, polypropylene, PEK, PEEK, or polyoxymethylene filaments, in particular preshrunk and/or set aramid filaments or high modulus polyester filaments.

The filaments (B) have an initial modulus of above 200 cN/tex, preferably 220 to 650 cN/tex, in particular 300 to 500 cN/tex, a tenacity of above 12 cN/tex, preferably 25 to 70 cN/tex, in particular 30 to 65 cN/tex, and a breaking extension of 20 to 50%, preferably 15 to 45%, in particular 20 to 35%.

Depending on the compliance or drapability required of the semifabricate, the filaments have linear densities of 0.5 to 25 dtex, preferably 0.7 to 15 dtex, in particular 0.8 to 10 dtex.

The filaments (B) are synthetic organic filaments. Provided they have the required, abovementioned melting point difference of at least 10° C., preferably 20° to 100° C., in particular 30° to 70° C., compared with the filaments (A), they can consist of the abovementioned high performance polymers. An example are filaments (B) made of polyetherimide (PEI) when the filaments (A) are made of glass, for example. However, other spinnable polymers can be used as polymer material of which the filaments (B) are made, for example vinyl polymers such as polyolefins, polyvinyl esters, polyvinyl ethers, poly(meth)acrylates, poly(aromatic vinyl)s, polyvinyl halides and also the various copolymers, block and graft polymers, liquid crystal polymers or else polyblends. Specific representatives of these groups are polyethylene, polypropylene, polybutene, polypentene, polyvinyl chloride, polymethyl methacrylate, poly(meth) acrylonitrile, modified or unmodified polystyrene or multiphase plastics such as ABS. Also suitable are polyaddition, polycondensation, polyoxidation or cyclization polymers. Specific representatives of these groups are polyamides, polyurethanes, polyureas, polyimides, polyesters, polyethers, polyhydantoins, polyphenylene oxide, polyphenylene sulfide, polysulfones, polycarbonates and also their mixed forms, mixtures and combinations with each other and with other polymers or polymer precursors, for example nylon-6, nylon-6,6, polyethylene terephthalate or bisphenol A polycarbonate.

Preferably the filaments (B) are drawn polyester, polyamide or polyetherimide filaments. Particular preference as filaments (B) is given to polyester POY filaments, in particular to polyethylene terephthalate filaments.

It is particularly preferable for the filaments (B) simultaneously to be the thermoplastic filaments (matrix filaments) whose melting point is at least 10° C. below the melting point of the reinforcing filaments (A) of the hybrid yarn of this invention.

In many cases it is desirable for the three-dimensionally shaped thermoplastic articles produced from the hybrid yarns of this invention via the sheetlike semifabricates to contain auxiliary and additive substances, for example fillers, stabilizers, delustrants or color pigments. In these cases it is advantageous for at least one of the filament varieties of the hybrid yarn to additionally contain such auxiliary and additive substances in an amount of up to 40% by weight, preferably up to 20% by weight, in particular up to 12% by weight of the weight of the fibrous constituents. Preferably the proportion of the thermoplastic fiber whose melting point is at least 10° C. lower than the melting point of the reinforcing filaments (A), i.e. the matrix fibers, contains the additional auxiliary and additive substances in an amount of up to 40% by weight, preferably up to 20% by weight, in particular up to 12% by weight of the weight of the fibrous constituents. Preferred auxiliary and additive substances for inclusion in the thermoplastic fiber content are fillers, stabilizers and/or pigments.

End products produced from the hybrid yarn of this invention are shaped fiber reinforced thermoplastic articles. These are produced from the hybrid yarn via sheetlike textile structures (semifabricate) which are capable of permanent three-dimensional deformation, since the reinforcing filaments present therein are in the crimped state.

The present invention accordingly also provides these textile sheet materials (semifabricates) consisting of or comprising a proportion of the above-described hybrid yarn of this invention sufficient to significantly influence the deformation capability of the textile sheet materials. The sheet materials of this invention can be wovens, knits, stabilized lays or bonded or unbonded random-laid webs. Preferably the sheet material is a knit or a stabilized, unidirectional or multidirectional lay, but in particular a woven.

In principle, the woven sheets may have any known weave construction, such as plain weave and its derivatives, for example rib, basket, huckaback or mock leno, twill and its many derivatives, of which only herringbone twill, flat twill, braid twill, lattice twill, cross twill, peak twill, zigzag twill, shadow twill or shadow cross twill are mentioned as examples, or satin/sateen with floats of various lengths. (For the weave construction designations cf. DIN 61101). The set of each of the woven sheets varies within the range from 2 to 60 threads/cm in warp and weft, depending on the use for which the material is intended and depending on the linear density of the yarns used in making the fabrics. Within this range of from 2 to 60 threads/cm in warp and weft, the sets of the woven fabric plies can be different or, preferably, identical.

In a further preferred embodiment of the textile materials of this invention, the textile sheets are knitted with synchronous or consecutive course formation. The textile sheets knitted with synchronous course formation can be warp-knitted or weft-knitted, and the constructions can be widely varied with loops or floats (cf. DIN 62050 and 62056).

A knitted textile material according to this invention can have rib, purl or plain construction and their known variants and also Jacquard patterning. Rib construction also comprehends for example its variants of plated, openwork, ribbed, shogged, wave, tuckwork, knob and also the interlock construction of 1×1 rib crossed. Purl construction also comprehends for example its variants of plated, openwork, interrupted, shogged, translated, tuckwork or knob. Plain construction also comprehends for example its variants of plated, floating, openwork, plush, inlay, tuckwork or knob.

The woven or knitted constructions are chosen according to the use intended for the textile material of this invention, usually from purely technical criteria, but occasionally also from decorative aspects.

As mentioned earlier, these novel sheet materials possess very good permanent deformation capability, in particular by deep drawing, since the reinforcing filaments present therein are in the crimped state. Preferably the reinforcing filaments (A) of the hybrid yarn contained therein are crimped by 5 to 60%, preferably 12 to 50%, in particular 18 to 36%.

The present invention also provides fiber reinforced shaped articles consisting of 20 to 90, preferably 35 to 85, in particular 45 to 75, % by weight of a sheetlike reinforcing material composed of low-shrinking filaments (A) and embedded in 10 to 80, preferably 15 to 45, in particular 25 to 55, % by weight of a thermoplastic matrix, 0 to 70, preferably 0 to 50, in particular 0 to 30% by weight of further fibrous constituents and additionally up to 40% by weight, preferably up to 20% by weight, in particular up to 12% by weight, of the weight of the fibrous and matrix constituents, of auxiliary and additive substances.

Sheetlike reinforcing materials embedded in the thermoplastic matrix can be sheets of parallel filaments arranged unidirectionally or, for example, multi-directionally in superposed layers, and are essentially elongate. However, they can also be wovens or knits, but preferably wovens.

The fiber reinforced shaped article of this invention includes as auxiliary and additive substances fillers, stabilizers and/or pigments depending on the requirements of the particular application. one characteristic of these shaped articles is that they are produced by deforming a textile sheet material composed of the above-described hybrid yarn, in which the reinforcing filaments are crimped, at a temperature which is above the melting point of the thermoplastic filaments and below the melting point of the reinforcing filaments (A). Here it is of importance that they are produced by an extensional deformation in which the crimped reinforcing filaments of the semifabricate are elongated and straightened at least in the region of the deformed parts.

The melting point of the filaments used for producing the hybrid yarn of this invention was determined in a differential scanning calorimeter (DSC) at a heating-up rate of 10° C./min. To determine the dry heat shrinkage and the temperature of maximum dry heat shrinkage of the filaments used, the filament was weighted with a tension of 0.0018 cN/dtex and the shrinkage-temperature diagram was recorded. The two values in question can be read off the curve obtained. To determine the maximum shrinkage force, a shrinkage force/temperature curve was continuously recorded at a heating-up rate of 10° C./min and at an inlet and outlet speed of the filament into and out of the oven. The two desired values can be taken from the curve.

The determination of the entanglement spacing as a measure of the degree of interlacing was carried out according to the principle of the hook-drop test described in U.S. Pat. No. 2,985,995 using an ITEMAT tester.

This invention further provides a process for producing the hybrid yarn of this invention, which comprises interlacing a first group of filaments (filaments (A)) and a second group of filaments (filaments (B)) in an interlacing or jet texturing means to which at least the filaments (A) are fed with an overfeed of 5 to 60%, wherein the filaments (A) of the first group have an initial modulus of above 600 cN/tex, preferably of 800 to 25,000 cN/tex, in particular of 2,000 to 20,000 cN/tex, a tenacity of above 60 cN/tex, preferably of 80 to 220 cN/tex, in particular of 100 to 200 cN/tex, and a breaking extension of 0.01 to 20%, preferably of 0.1 to 7.0%, in particular of 1.0 to 5.0%, and the filaments (B) of the second group are thermoplastic filaments which have a melting point which is at least 10° C., preferably 20° to 100° C., in particular 30° to 70° C., below the melting point of the filaments (A).

In a variant, filaments (A) having a crimp of 5% to 60%, preferably of 12 to 50%, in particular of 18 to 36%, are interlaced with filaments (B) with or without overfeed or filaments (A) having no crimp are interlaced with filaments (B) with overfeed.

"Overfeed" of filaments (A) means that the interlacing means is fed with a greater length per unit time of filaments (A) than of filaments (B). The interlacing preferably corresponds to an entanglement spacing of below 200 mm, preferably within the range from 5 to 100 mm, in particular within the range from 10 to 30 mm.

The process steps required for producing a shaped fiber reinforced thermoplastic article from the hybrid yarn of this invention likewise form part of the subject-matter of the present invention.

The first of these steps is a process for producing a textile sheet material (semifabricate) by weaving, knitting, laying or random laydown of the hybrid yarn of this invention with or without other yarns, which comprises using the hybrid yarn of this invention having the features described above and selecting the proportion of hybrid yarn so that it significantly influences the permanent deformation capacity of the sheet material. Preferably the proportion of hybrid yarn used relative to the total amount of woven, knitted, laid, or randomly laid down yarn is 30 to 100% by weight, preferably 50 to 100% by weight, in particular 70 to 100% by weight.

Preferably the sheet material is produced by weaving with a set of 4 to 20 threads/cm or by unidirectional or multidirectional laying of the hybrid yarns and stabilization of the lay by means of transversely laid binding threads or by local or whole-area bonding.

It is particularly preferable and advantageous to use a hybrid yarn wherein the degree of crimp of the filaments (A) has been set so that it corresponds approximately to the extension which takes place during processing.

The last step of processing the hybrid yarn of this invention is the production of a fiber reinforced shaped article consisting of 20 to 90, preferably 35 to 85, in particular 45 to 75, % by weight of a sheetlike fibrous material composed of filaments (A) and embedded in 10 to 80, preferably 15 to 45, in particular 25 to 55, % by weight of a thermoplastic matrix, and 0 to 70, preferably 0 to 50, in particular 0 to 30, % by weight of further fibrous constituents and additionally up to 40% by weight, preferably up to 20% by weight, in particular up to 12% by weight, of the weight of the fibrous and matrix constituents, of auxiliary and additive substances, which comprises producing it by deforming an above-described permanent deformation capable textile sheet material of this invention from hybrid yarn of this invention at a temperature which is above the melting point of the thermoplastic filaments (B) and below the melting point of the reinforcing filaments (A).

EXAMPLES

The Examples which follow illustrate the production of the hybrid yarn of this invention, of the semifabricates I and II of this invention, and of a shaped fiber reinforced thermoplastic article of this invention.

EXAMPLE 1

A 2×680 dtex multifilament glass yarn and a 5×300 dtex (=1500 dtex) 64 filament polyethylene terephthalate yarn are conjointly fed into an interlacing jet where they are interlaced by a compressed air stream. The glass yarn is in fact fed into the interlacing jet at a speed 25% greater than that of the polyethylene terephthalate yarn (25% overfeed). The polyester yarn has a melting point of 250° C. The interlaced hybrid yarn obtained has a linear density of 3200 dtex; the entanglement spacing, as measured with the ITEMAT tester, is 19 mm.

EXAMPLE 2

A 220 dtex 200 filament high modulus aramid yarn with a crimp of 35% and a 3 x 110 dtex 128 filament polyethylene terephthalate yarn are conjointly fed into an interlacing jet where they are interlaced by a compressed air stream. The aramid yarn and the polyethylene terephthalate yarn are fed to the interlacing jet at approximately the same speed. The polyester yarn has a melting point of 250° C. The interlaced hybrid yarn obtained has a linear density of 630 dtex; the entanglement spacing, as measured with the ITEMAT tester, is 21 mm.

EXAMPLE 3

The hybrid yarn produced in Example 1 is woven up into a fabric with a plain weave. The number of ends per cm is 7.4, the number of pits per cm is 8.2. This fabric (semifabricate) has good permanent deformation capability. The possible area enlargement on deformation is about 30%. A fabric having mostly the same properties can be obtained from the hybrid yarn produced in Example 2.

EXAMPLE 4

A semifabricate II produced as described in Example 3 is drawn into a fender shape and heated at 280° C. for 3 minutes. After cooling down to about 80° C., the crude fender shape can be taken out of the deep-drawing mold. The shaped fiber-reinforced thermoplastic article obtained has excellent strength. Its reinforcing filaments are very uniformly distributed and substantially elongate.

The article is finished by cutting, smoothing and coating.

What is claimed is:

1. A hybrid yam consisting of two groups of filaments, one group consisting of one or more varieties of reinforcing filaments (A) and the other group consisting of one ore more varieties of matrix filaments (B), wherein the filaments (A) of the first group have an initial modulus of above 600 cN/tex and a tenacity of above 60 cN/tex and a breaking extension of 0.01 to 20%, the filaments (B) of the second group are thermoplastic filaments which have a melting point which is at least 10° C. below the melting point of the filaments (A), the filaments (A) have a crimp of 5 to 60%, and wherein the filaments (A) and the filaments (B) are interlaced.

2. The hybrid yarn of claim 1 wherein the filaments (A) of the first group have an initial modulus of 800 to 25,000 cN/tex and a tenacity of 80 to 220 cN/tex and a breaking extension of 0.1 to 7.0%, the filaments (B) of the second group are thermoplastic filaments which have a melting point which is 20° to 100° C. below the melting point of the filaments (A), the filaments (A) have a crimp of 12 to 50%.

3. The hybrid yarn of claim 1 wherein the filaments (A) of the first group have an initial modulus of 2,000 to 20,000 cN/tex, a tenacity of 100 to 200 cN/tex, and a breaking extension of 1.0 to 5.0%, the filaments (B) of the second group are thermoplastic filaments which have a melting point which is 30° to 70° C., below the melting point of the filaments (A), the filaments (A) have a crimp of 18 to 36%.

4. The hybrid yarn of claim 1 having a linear density of from 100 to 25,000 dtex.

5. The hybrid yarn of claim 1 having a linear density of from 150 to 15,000 dtex.

6. The hybrid yarn of claim 1 having a linear density of from 200 to 10,000 dtex.

7. The hybrid yarn of claim 1, wherein the proportion of the filaments (A) is 20 to 90% by weight, the proportion of the filaments (B) is 10 to 80% by weight and the proportion of the rest of the fibrous constituents is 0 to 70% by weight of the hybrid yarn.

8. The hybrid yarn of claim 7, wherein the proportion of the filaments (A) is 35 to 85% by weight, the proportion of the filaments (B) is 15 to 45% by weight and the proportion of the rest of the fibrous constituents is 0 to 50% by weight of the hybrid yarn.

9. The hybrid yarn of claim 8, wherein the proportion of the filaments (A) is 45 to 75% by weight, the proportion of the filaments (B) is 25 to 55% by weight and the proportion of the rest of the fibrous constituents is 0 to 30% by weight of the hybrid yarn.

10. The hybrid yarn of claim 1, wherein the filaments (A) have a dry heat shrinkage maximum of below 3%.

11. The hybrid yarn of claim 1, wherein the filaments (A) have a linear density of 0.1 to 20 dtex.

12. The hybrid yarn of claim 11, wherein the filaments (A) have a linear density of 0.4 to 16 dtex.

13. The hybrid yarn of claim 12, wherein the filaments (A) have a linear density of 0.8 to 10 dtex.

14. The hybrid yarn of claim 1, wherein the filaments (A) are inorganic, filaments composed of high performance polymers or preshrunk and/or set organic filaments.

15. The hybrid yarn of claim 1, wherein the filaments (A) are metal, glass, ceramic or carbon filaments.

16. The hybrid yarn of claim 1, wherein the filaments (A) are glass filaments.

17. The hybrid yarn of claim 1, wherein the filaments (A) are preshrunk and/or set high modulus aramid filaments or high modulus polyester filaments.

18. The hybrid yarn of claim 1, wherein the filaments (B) are synthetic organic filaments.

19. The hybrid yarn of claim 1, wherein the filaments (B) are polyester, polyamide or polyetherimide filaments.

20. The hybrid yarn of claim 1, wherein the filaments (B) are polyethylene terephthalate filaments.

21. The hybrid yarn of claim 1, wherein at least one of the filament varieties of the hybrid yarn additionally includes auxiliary and additive substances in an amount of up to 40% by weight of the weight of the fibrous constituents.

22. The hybrid yarn of claim 21, wherein at least one of the filament varieties of the hybrid yarn additionally includes auxiliary and additive substances in an amount of up to 20% by weight of the weight of the fibrous constituents.

23. The hybrid yarn of claim 22, wherein at least one of the filament varieties of the hybrid yarn additionally includes auxiliary and additive substances in an amount of up to 12% by weight of the weight of the fibrous constituents.

24. A permanent deformation capable textile sheet material consisting of or comprising a proportion of the hybrid yarn of claim 1 sufficient to significantly influence its deformation capability.

25. The sheet material of claim 24 as a woven, a knit, a stabilized lay or a bonded or unbonded random-laid web.

26. The sheet material of claim 24 as a woven.

27. The sheet material of claim 24 as a stabilized, unidirectional lay.

28. The sheet material of claim 24, wherein the filaments (A) of the hybrid yarn are crimped by 5 to 60%.

29. The sheet material of claim 28, wherein the filaments (A) of the hybrid yarn are crimped by 12 to 50%.

30. The sheet material of claim 29, wherein the filaments (A) of the hybrid yarn are crimped by 18 to 36%.

31. A method of using a hybrid yarn as claimed in claim 1 for producing a permanent deformation capable sheet material.

32. A method of using the permanent deformation capable sheet material of claim 24 for producing a fiber reinforced shaped article.

* * * * *

UNITED STATES PATENT AND TRADEMARK OFFICE

CERTIFICATE OF CORRECTION

PATENT NO. : 5,792,555

DATED : AUGUST 11, 1998

INVENTOR(S) : HENNING BAK ET AL

It is certified that error appears in the above-identified patent and that said Letters Patent is hereby corrected as shown below:

On the title page item [57],

In the Abstract, line 17, "S" should read -- 5 --;

Column 2, line 46, "BP-" should read -- EP- --;

Column 4, line 57, "PEEK" should read -- PEEKK --;

Column 7, line 9, "one" should read -- One --;

Column 9, line 21 (claim 1, line 1), "yam" should read -- yarn --; and line 23 (claim 1, line 3), "ore" should read -- or --;

Signed and Sealed this

Eighth Day of December, 1998

Bruce Lehman

*Attest:*

BRUCE LEHMAN

*Attesting Officer*

*Commissioner of Patents and Trademarks*